US007292810B2

(12) United States Patent
Tanner et al.

(10) Patent No.: US 7,292,810 B2
(45) Date of Patent: Nov. 6, 2007

(54) LIQUID ELECTROPHOTOGRAPHIC IMAGING DEVICE AND METHODS

(75) Inventors: Christopher S. Tanner, La Mesa, CA (US); Ziv Gilan, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 70 days.

(21) Appl. No.: 11/166,501

(22) Filed: Jun. 24, 2005

(65) Prior Publication Data

US 2006/0291907 A1 Dec. 28, 2006

(51) Int. Cl.
*G03G 15/10* (2006.01)

(52) U.S. Cl. ..... 399/240; 399/237

(58) Field of Classification Search ..... 399/237, 399/239, 240, 241, 249
See application file for complete search history.

(56) References Cited

U.S. PATENT DOCUMENTS

| | | | | |
|---|---|---|---|---|
| 3,687,109 | A | 8/1972 | Egnaczak | |
| 3,908,037 | A | 9/1975 | Blckmore et al. | |
| 4,373,800 | A | 2/1983 | Kamiyama et al. | |
| 5,561,264 | A * | 10/1996 | Iino et al. | 399/240 |
| 5,826,148 | A | 10/1998 | Iino et al. | |
| 5,943,534 | A | 8/1999 | Watanabe | |
| 5,943,535 | A | 8/1999 | Watanabe | |
| 6,038,421 | A | 3/2000 | Yoshino et al. | |
| 6,108,508 | A | 8/2000 | Takeuchi et al. | |
| 6,317,578 | B1 * | 11/2001 | Kusayanagi | 399/249 X |
| 6,415,124 | B1 | 7/2002 | Nishikawa | |
| 6,571,075 | B2 | 5/2003 | Nakashima et al. | |
| 6,636,716 | B2 | 10/2003 | Yoshino | |
| 6,694,112 | B2 | 2/2004 | Sasaki et al. | |
| 6,766,130 | B2 * | 7/2004 | Song et al. | 399/240 X |
| 6,829,460 | B2 | 12/2004 | Kurotori et al. | |
| 6,850,724 | B2 | 2/2005 | Pang et al. | |
| 2004/0071479 | A1 | 4/2004 | Yoshino | |

FOREIGN PATENT DOCUMENTS

| | | |
|---|---|---|
| EP | 0725322 | 8/1996 |
| JP | 06019266 | 1/1994 |
| JP | 10282795 | 10/1998 |
| JP | 10339990 | 12/1998 |
| WO | WO 03/014835 | 2/2003 |
| WO | WO 01/92962 | 12/2004 |

OTHER PUBLICATIONS

PCT/US2006/022226, Hewlett-Packard Development Company, L.P., Jun. 7, 2006.

* cited by examiner

*Primary Examiner*—Sandra L. Brase

(57) ABSTRACT

An embodiment includes developing unit having a first developer roller and a second developer roller in contact with the first developer roller. The first developer roller is adapted to transfer developed liquid developer to the second developer roller, and the second developer roller is adapted to transfer the developed liquid developer to a photoconductor. An electrode is separated from the first developer roller by a gap. The gap is configured to receive undeveloped liquid developer from a reservoir remote from the developing unit so that the first developer roller does not pass through undeveloped liquid developer contained in a reservoir within the developing unit.

24 Claims, 2 Drawing Sheets

LIQUID ELECTROPHOTOGRAPHIC IMAGING DEVICE AND METHODS

BACKGROUND

Liquid (or ink) electrophotographic imaging devices typically utilize a light source, such as a laser or light emitting diodes, to expose regions of a photoconductor, e.g., a rotating photoconductor drum, to form a latent image on a photoconductor. A visible image is formed on the photoconductor using developed liquid developer having charged toner particles dispersed in a liquid carrier. More specifically, the developed liquid developer is transferred to the regions of the photoconductor exposed by the light. For some electrophotographic imaging devices, the developed liquid developer is formed on a first developer roller having an electrical charge by rotating the first roller through undeveloped liquid developer contained in a reservoir. The developed liquid developer is then transferred to a rotating second developer roller by an electrostatic force due to a difference in electrostatic potential between the first and second developer rollers. The developed liquid developer is then transferred to the photoconductor. One problem with this is that liquid developer can spill over the first and second developer rollers.

DETAILED DESCRIPTION

In the following detailed description of the present embodiments, reference is made to the accompanying drawings that form a part hereof, and in which is shown by way of illustration specific embodiments that may be practiced. These embodiments are described in sufficient detail to enable those skilled in the art to practice disclosed subject matter, and it is to be understood that other embodiments may be utilized and that process, electrical or mechanical changes may be made without departing from the scope of the claimed subject matter. The following detailed description is, therefore, not to be taken in a limiting sense, and the scope of the claimed subject matter is defined only by the appended claims and equivalents thereof.

Figure 1:
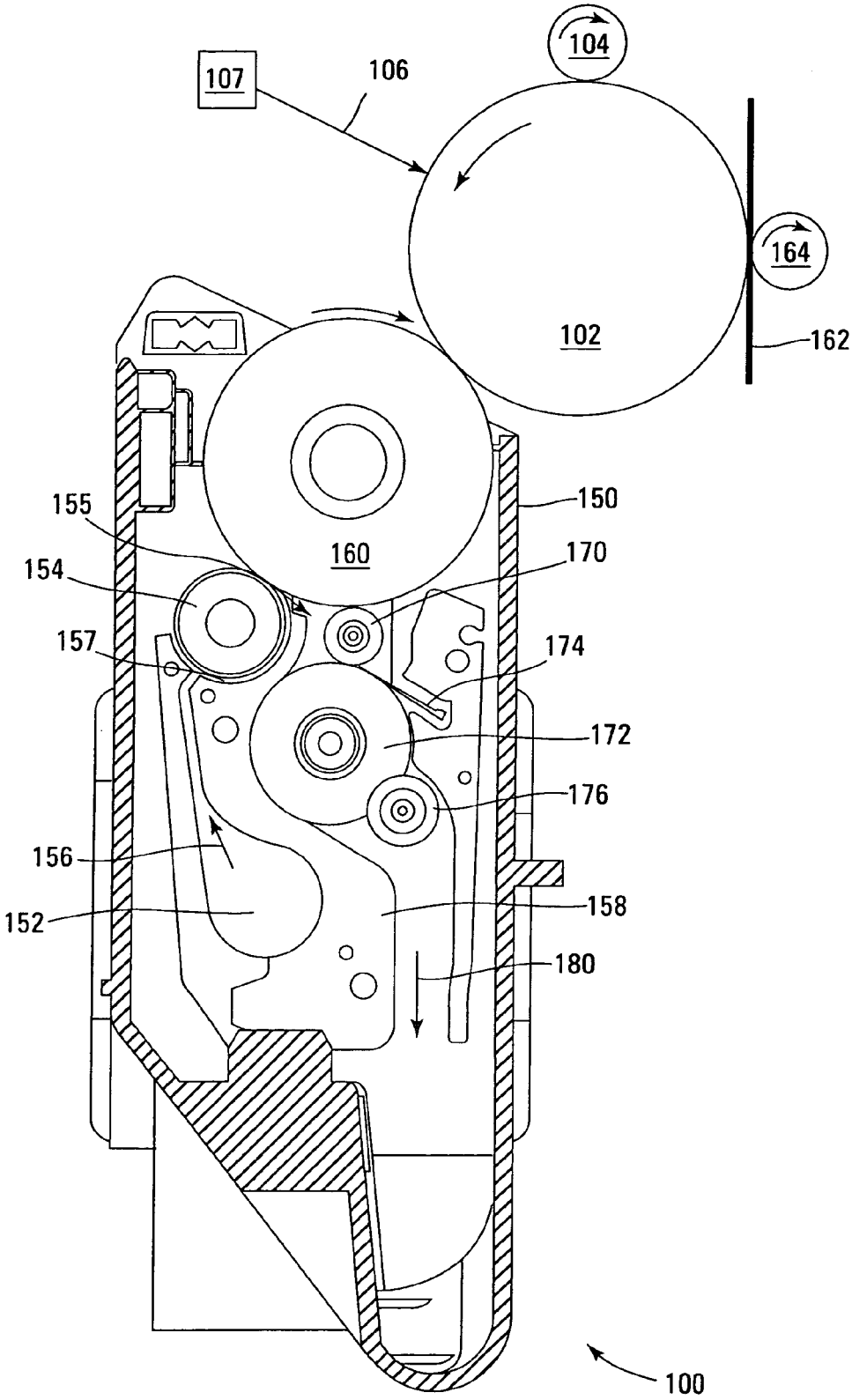
FIG. 1 illustrates a portion of an embodiment of a liquid electrographic imaging device, according to an embodiment of the disclosure.

FIG. 1 illustrates a portion, e.g., a print engine 100, of a liquid (or ink) electrographic imaging device, according to an embodiment. Print engine 100 includes a photoconductor drum 102. For one embodiment, as photoconductor drum 102 rotates in the direction shown, a charge roller 104 rotates in contact with photoconductor drum 102 to charge photoconductor drum 102 to a substantially uniform charge. After photoconductor drum 102 is charged, light from a light beam 106, such as a laser beam, from a light source 107 is directed at pre-selected locations on photoconductor drum 102 to create discharged regions at those locations, thereby creating a latent image on photoconductor drum 102. For one embodiment, light source 107 may be an array of light emitting diodes and light beam 106 a beam from one of the light emitting diodes. Print engine 100 further includes a developing unit 150 for disposing developed liquid developer on photoconductor drum 102.

Undeveloped liquid developer, e.g., a carrier liquid containing marking material particles, e.g., toner particles, is received at an inlet 152 of developing unit 150, e.g., from a reservoir remote from developing unit 150. For one embodiment, undeveloped liquid developer may be about 2 percent toner particles by volume, and developed liquid developer may be about 20 percent toner particles by volume and therefore is rather thicker than the undeveloped liquid developer.

Undeveloped liquid developer flows toward a first developer roller 154 from inlet 152, as indicated by an arrow 156. As first developer roller 154 rotates, first developer roller 154 produces a viscous pumping action that acts to draw the undeveloped liquid developer into a gap 157, e.g., of about 300 to about 800 microns, between an electrode 158 and developer roller 154. Electrode 158 and first developer roller 154 are at unequal voltages so that an electric field, e.g., of about 500 to about 2000 volts, exists between electrode 158 and developer roller 154. The electric field develops the undeveloped liquid developer in the gap 157 and forces developed liquid developer onto first developer roller 154.

Note that the first developer roller 154 does not rotate through undeveloped liquid developer contained within a reservoir within developing unit 150 to dispose developed liquid toner on the first developer roller, as occurs for some conventional liquid electrographic imaging devices. Instead, the undeveloped liquid developer flows from a remote reservoir through inlet 152. This acts to reduce liquid developer spillage and settling of toner particles that can occur when rotating the first developer roller 154 through undeveloped liquid developer contained within a reservoir to dispose developed liquid toner on the first developer roller 154.

Any liquid that does not get developed within gap 157 and transferred to the first developer roller 154 is carried by the viscous action produced by the first developer roller 154 through gap 157, as indicated by an arrow 155, into a cleaning region located generally below a second developer roller 160 and including a cleaning roller 170, a sponge roller 172, a scraper 174, and a squeezing roller 176. This liquid is relatively clean and typically includes fewer toner particles than the undeveloped liquid developer.

A voltage difference between the second developer roller 160 in rolling contact with the first developer roller 154 produces an electric field, e.g., of about 200 to about 800 volts, forces the developed liquid developer from the first developer roller 154 to the second developer roller 160, as second developer roller 160 rotates in the direction shown. For one embodiment, a contact force, e.g., of about 0 (zero) to about 150 Newtons, between the first developer roller 154 and the second developer roller 160 acts to shear the toner particles to reduce particle agglomeration and to remove or squeegee excess liquid. For one embodiment, the first developer roller 154 may be of metal, such as stainless steel plated with chrome or nickel, and the second developer roller 160 may have a metal core coated with plastic, such as polyurethane.

Second developer roller 160 rolls in contact with photoconductor drum 102, and the developed liquid developer is transferred from second developer roller 160 to the discharged regions formed on photoconductor drum 102 by exposing them to light beam 106, thereby producing a visible image on photoconductor drum 102. The image is then transferred on to a media sheet 162, such as paper, plastic, etc., that for one embodiment passes through a nip between photoconductor drum 102 and a transfer roller 164, where heat and/or pressure are applied thereto to fuse the developed liquid developer onto media 162. For other embodiments, the developed liquid developer is transferred to an intermediate transfer belt (not shown, but located where media sheet 162 is located) that in turn transfers the developed liquid developer to the media and then fuses it.

Any remaining portion of the developed liquid developer that does not get transferred to photoconductor drum 102 is transferred from second developer roller 160 to cleaning roller 170, rolling in contact with the second developer roller 160, due to an electric field, e.g., of about 0 (zero) to about 500 volts, between the second developer roller 160 and the cleaning roller 170. Sponge roller 172 rolls in contact with cleaning roller 170 and scraper 174 rides on a surface of cleaning roller 170. Sponge roller 172 and scraper 174 act to remove at least a portion of the developed liquid developer from cleaning roller 170. The developed liquid developer from cleaning roller 170 gets mixed with the relatively clean liquid from gap 157. In turn, a squeezing roller 176 rolls against sponge roller 172 to squeeze (or ring) the mixture from sponge roller 172. The mixture then exits development unit 150, as indicated by arrow 180, and is returned to the remote reservoir.

Figure 2:
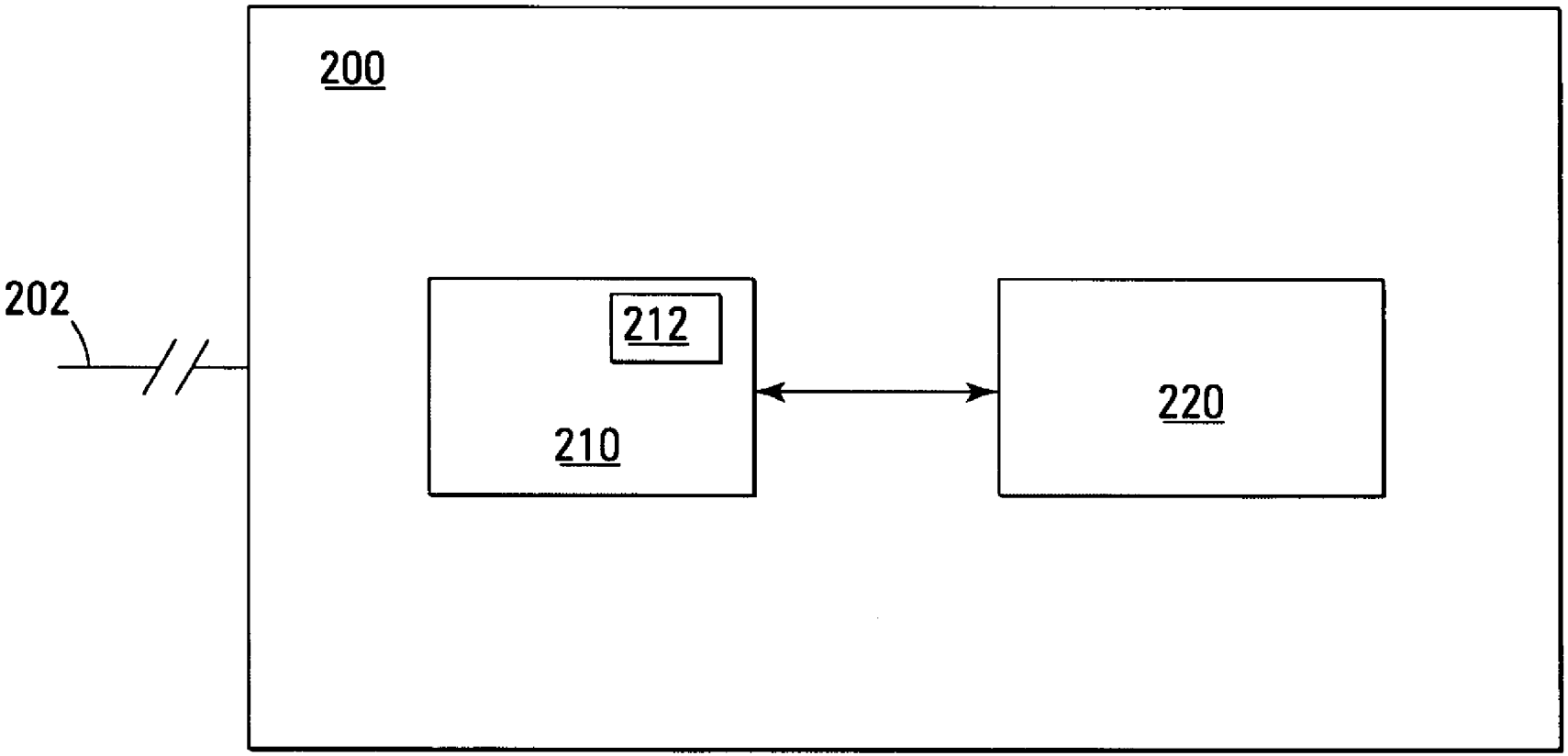
FIG. 2 is a block diagram of an embodiment of an imaging device, according to another embodiment of the present disclosure.

FIG. 2 is a block diagram of an electrographic imaging device 200, according to another embodiment. Imaging device 200 can be a printer, an industrial digital printing press, a copier, digital network copier, a multi-function peripheral (MFP), a facsimile machine, etc. Imaging device 200 may be connected directly to a personal computer, workstation, or other processor-based device system, or to a data network, such as a local area network (LAN), the Internet, a telephone network, etc., via an interface 202.

For one embodiment imaging device 200, receives image data via interface 202. Imaging device 200 has a controller 210, such as a formatter, for interpreting the image data and rendering the image data into a printable image. The printable image is provided to a print engine 220 to produce a hardcopy image on a media sheet. For one embodiment, print engine 220 is as described above for print engine 100 of FIG. 1. For another embodiment, the imaging device 200 is capable of generating its own image data, e.g., a copier via scanning an original hardcopy image.

Controller 210 includes a memory 212, e.g., a computer-usable storage media that can be fixedly or removably attached to controller 210. Some examples of computer-usable media include static or dynamic random access memory (SRAM or DRAM), read-only memory (ROM), electrically-erasable programmable ROM (EEPROM or flash memory), magnetic media and optical media, whether permanent or removable. Memory 212 may include more than one type of computer-usable storage media for storage of differing information types. For one embodiment, memory 212 contains computer-readable instructions, e.g., drivers, adapted to cause controller 210 to format the data received by imaging device 200, via interface 202 or by scanning, and computer-readable instructions to cause imaging device 200 to perform the various methods described above.

CONCLUSION

Although specific embodiments have been illustrated and described herein it is manifestly intended that the scope of the claimed subject matter be limited only by the following claims and equivalents thereof.

What is claimed is:

1. A developing unit, comprising:

a first developer roller;

a second developer roller in contact with the first developer roller, wherein the first developer roller is adapted to transfer developed liquid developer to the second developer roller, wherein the second developer roller is adapted to transfer the developed liquid developer to a photoconductor; and a stationary electrode separated from the first developer roller by a gap, wherein the gap is configured to receive undeveloped liquid developer from a reservoir remote from the first developer roller and the gap so that the first developer roller does not pass through undeveloped liquid developer contained in a reservoir.

2. The developing unit of claim 1, wherein the first and second developer rollers are electrically chargeable for producing an electric field therebetween for forcing the developed liquid developer from the first to the second developer roller.

3. The developing unit of claim 1, wherein the first roller and the electrode are electrically chargeable for producing an electric field therebetween for developing the undeveloped liquid developer in the gap and forcing the developed liquid developer onto the first developer roller.

4. The developing unit of claim 1, wherein the first and second developer rollers are in forcible contact.

5. The developing unit of claim 1 further comprises a cleaning roller in contact with the second developer roller.

6. The developing unit of claim 5 further comprises a scraper in contact with the cleaning roller.

7. The developing unit of claim 5 further comprises a sponge roller in contact with the cleaning roller.

8. The developing unit of claim 5, wherein the cleaning roller is electrically chargeable.

9. An imaging device, comprising:

a photoconductor;

a first developer roller;

a second developer roll in contact with the first developer roller and the photoconductor, wherein the first developer roller is adapted to transfer developed liquid developer to the second developer roller and the second developer roller is adapted to transfer the developed liquid to the photoconductor;

stationary electrode separated from the first developer roller by a gap; and a cleaning roller in contact with the second developer roller;

wherein the first and second developer rollers are adapted to be electrically charged for producing an electric field therebetween for forcing the developed liquid developer from the first to the second developer roller; and wherein the cleaning roller and the second developer roller are adapted to be electrically charged to produce an electrical field therebetween for transferring developed liquid developer that does not get transferred to the photoconductor from the second developer roller to the cleaning roller from the second developer roller.

10. The imaging device of claim 9 further comprises a scraper in contact with the cleaning roller.

11. The imaging device of claim 9 further comprises a sponge roller in contact with the cleaning roller.

12. The imaging device of claim 9, wherein the first and second developer rollers are in forcible contact.

13. The imaging device of claim 9 further comprises a light source for exposing the photoconductor.

14. An imaging device, comprising:

a means for transferring undeveloped liquid developer to a gap between a stationary electrode and a first developer roller;

a means for developing the undeveloped liquid developer within the gap;

a means for transferring the developed liquid developer onto the first developer roller;

a means for transferring the developed liquid developer from the first developer roller to a second developer roller;

a means for transferring the developed liquid developer from the second developer roller to portions of a photoconductor; and a means for transferring developed liquid developer that is not transferred from the second developer roller to the photoconductor to a cleaning roller from the second developer roller in response to an electric field between the second developer roller and the cleaning roller.

15. The imaging device of claim 14 further comprises a means for removing at least a portion of the developed liquid developer from the cleaning roller.

16. A method of operating a developing unit of an electrographic imaging device, comprising:

receiving an undeveloped liquid developer at a gap disposed between stationary electrode and a first developer roller directly from a reservoir remote from the first developer roller and the gap so that the first developer roller does not pass through undeveloped liquid developer contained in a reservoir;

generating a first electric field between the electrode and the first developer roller to develop the undeveloped liquid in the gap and transfer developed liquid developer onto the first developer roller;

generating a second electric field between the first developer roller and a second developer roller to transfer the developed liquid developer from the first developer roller to the second developer roller; and generating a third electric field between the second developer roller and portions of a photoconductor to transfer the developed liquid developer from the second developer roller to the portions of a photoconductor.

17. The method of claim 16 further comprises exposing portions of the photoconductor to light.

18. The method of claim 16 further comprises directing liquid that does not get developed within the gap to a cleaning region of the developing unit.

19. The method of claim 18, wherein directing liquid that does not get developed within the gap to a cleaning region of the developing unit comprises using a viscous action produced by the first developer roller.

20. The method of claim 19 further comprises generating a fourth electric field between the second developer roller and a cleaning roller to transfer developed liquid developer that is not transferred to the portions of the photoconductor from the second developer roller to the cleaning roller.

21. The method of claim 20 further comprises mixing the liquid that does not get developed within the gap with the developed liquid developer from the cleaning roller within the cleaning region.

22. A method of operating an electrographic imaging device, comprising:

transferring undeveloped liquid developer to a gap between a stationary electrode and a first developer roller;

developing the undeveloped liquid developer within the gap;

transferring the developed liquid developer onto the first developer roller;

transferring the developed liquid developer from the first developer roller to a second developer roller;

transferring the developed liquid developer from the second developer roller to portions of a photoconductor; and transferring developed liquid developer that is not transferred from the second developer roller to the photoconductor to a cleaning roller from the second developer roller in response to an electric field between the second developer roller and the cleaning roller.

23. The method of claim 22 further comprises scraping the developed liquid developer from the cleaning roller.

24. The method of claim 22 further comprises sponging the developed liquid developer from the cleaning roller using a sponge roller.

* * * * *

UNITED STATES PATENT AND TRADEMARK OFFICE

CERTIFICATE OF CORRECTION

PATENT NO. : 7,292,810 B2
APPLICATION NO. : 11/166501
DATED : November 6, 2007
INVENTOR(S) : Christopher S. Tanner et al.

It is certified that error appears in the above-identified patent and that said Letters Patent is hereby corrected as shown below:

In column 3, line 1, after “media” insert -- sheet --.

In column 4, line 36, in Claim 9, delete “roll” and insert -- roller --, therefor.

In column 4, line 42, in Claim 9, insert -- a -- before “stationary”.

In column 5, line 22, in Claim 16, after “between” insert -- a --.

Signed and Sealed this

Twenty-ninth Day of July, 2008

JON W. DUDAS
*Director of the United States Patent and Trademark Office*